US005169077A

United States Patent [19]

Stelk

[11] Patent Number: 5,169,077

[45] Date of Patent: Dec. 8, 1992

[54] REPLACEABLE END MEMBER FOR A HAMMERMILL SPIDER

[75] Inventor: John C. Stelk, Betendorf, Iowa

[73] Assignee: Sivyer Steel Corporation, Betendorf, Iowa

[21] Appl. No.: 266,091

[22] Filed: Nov. 2, 1988

[51] Int. Cl.[5] ..... B02C 13/04; B02C 13/28

[52] U.S. Cl. ..... 241/194; 241/197

[58] Field of Search ..... 241/193, 194, 197, 277, 241/300

[56] References Cited

U.S. PATENT DOCUMENTS

| | | | |
|---|---|---|---|
| 1,268,394 | 6/1918 | Shamblen | 241/277 |
| 3,727,848 | 4/1973 | Francis | 241/197 X |
| 4,222,530 | 9/1980 | Whitney | 241/197 X |
| 4,313,575 | 2/1982 | Stepanek | 241/197 X |
| 4,519,551 | 5/1985 | Ceurvorst | 241/197 X |

*Primary Examiner*—Joseph M. Gorski
*Attorney, Agent, or Firm*—Foley & Lardner

[57] ABSTRACT

A spider assembly for a rotary hammer assembly for a hammermill, the spider assembly including a spider having a number of arms, a replaceable end member mounted on the end of each arm and a protective cap mounted on the end of the replaceable member. The replaceable member including a contoured web that matingly engages a corrresponding socket in the spider arm. The web and socket including corresponding abutments for resisting the centrifigal force of the rotary motion of the hammer assembly. The protective cap is provided with a shroud having a contoured surface that matingly engages and protects the face of the end member.

7 Claims, 3 Drawing Sheets

REPLACEABLE END MEMBER FOR A HAMMERMILL SPIDER

BACKGROUND OF THE INVENTION

1. Field of the Invention

This invention relates to a spider assembly for the rotary hammer assembly of a hammermill and more particularly, to a replaceable end member for each arm of the spider.

2. Description of the Prior Art

Hammermills of the type contemplated herein include a rotary hammer assembly that has a number of spiders mounted on a shaft with hammers mounted for rotary motion between the arms of the spiders. During operation of the hammermill, the hammer assembly is rotated continuously to allow the hammers to swing past stationary combs and grate bars to impinge upon and fragmentize the metal objects fed into the mill.

To be effective, the orbit of the hammers must be quite close to the combs and grate bars with the extremities of the spiders actively involved in the fragmentizing action. As a result, the outer end portions of the spider arms are subjected to severe wear. In order to protect the tips of the spider arms, protective caps or tips are provided to protect the impact area on the lead edge of the spider arm. While the concept of protecting the ends of the spider arms with such tips or caps is not new, it has been found that the end of the spider arms, particularly the side walls, are also subjected to severe damage in the fragmentizing action. If the spiders are not replaced, the connections between the spider arms and hammers is weakened.

In order to repair the end of the spider arms, the spiders must be removed from the hammermill, thus causing shut down and considerable time loss and a reduction in the efficiency of operation due to the time required to dismantle the hammermill and replace the spiders.

A number of devices have been developed to protect the rotating parts of hammermill assemblies as a result of the impact of the rotating parts with the metal objects to be fragmentized in the hammermill. In Ratkowski U.S. Pat. No. 3,367,585 entitled "Replaceable Tip Member for a Two-Part Hammer" and Hightower U.S. Pat. No. 3,844,494 entitled "Hammer Mill Rotor Assembly" the problem of severe wear to the hammers was solved by providing a replaceable tip member on the hammer. In the '585 patent, a replaceable tip member is provided on the end of the hammer. In the '494 patent, heavy hammers were mounted on the forward portion of the spider. When the replaceable tip member became worn the pivot axis of the hammer was moved from the leading edge of the spider to the center of the spider. A cap was then mounted on the spider to protect the impact area of the spider.

In the Whitney U.S. Pat. No. 4,290,545 entitled "Method of Attaching A Protective Cap to a Shredder Component" the end disks on the hammer assembly are provided with a protective cap which is secured to the outer edge of the disk to protect the inside surface of the disk from impact by fragmentized metal objects.

In the Francis U.S. Pat. No. 3,727,848 entitled "Hammer Mill with Replaceable Spider Arm Tips" a replaceable tip or cap is disclosed which is mounted on the leading edge of the outer end of the spider to protect the spider from impact damage from the fragmentized metal objects.

SUMMARY OF THE INVENTION

The present invention relates to a replaceable end member which can be simply and easily mounted on and removed from the spider for repair or replacement without removing the spider from the hammermill. This has resulted in a significant reduction in down time in the operation of the hammermill.

The replaceable end member includes a body portion having a contoured web on one end to resist the centrifugal force of the rotary motion of the spider. The web is shaped to engage a correspondingly shaped socket in the spider arm. The end member is also provided with a slot on the back face that is aligned with a correspondingly shaped extension on the spider arm for securing the end member to the spider arm.

One of the primary advantages of the invention is the provision of replaceable end members that are securely attached to the arms of the spider yet easily removed from the spider arm for replacement or repair.

A further feature of the invention is the provision of an end member that can accommodate a protective tip having a shroud portion for protecting the impact area of the end member.

Another feature of the invention is the ability to reuse the worn hammers by replacing the end members with new end members having the hammer pin holes located on a larger diameter circle from the axis of rotation of the hammer assembly so that the working surface of the worn hammers is closer to the cutting comb and grate bars.

Other features and advantages of the invention will become apparent upon reviewing the following drawings, the detailed description and the appended claims.

Figure 1:
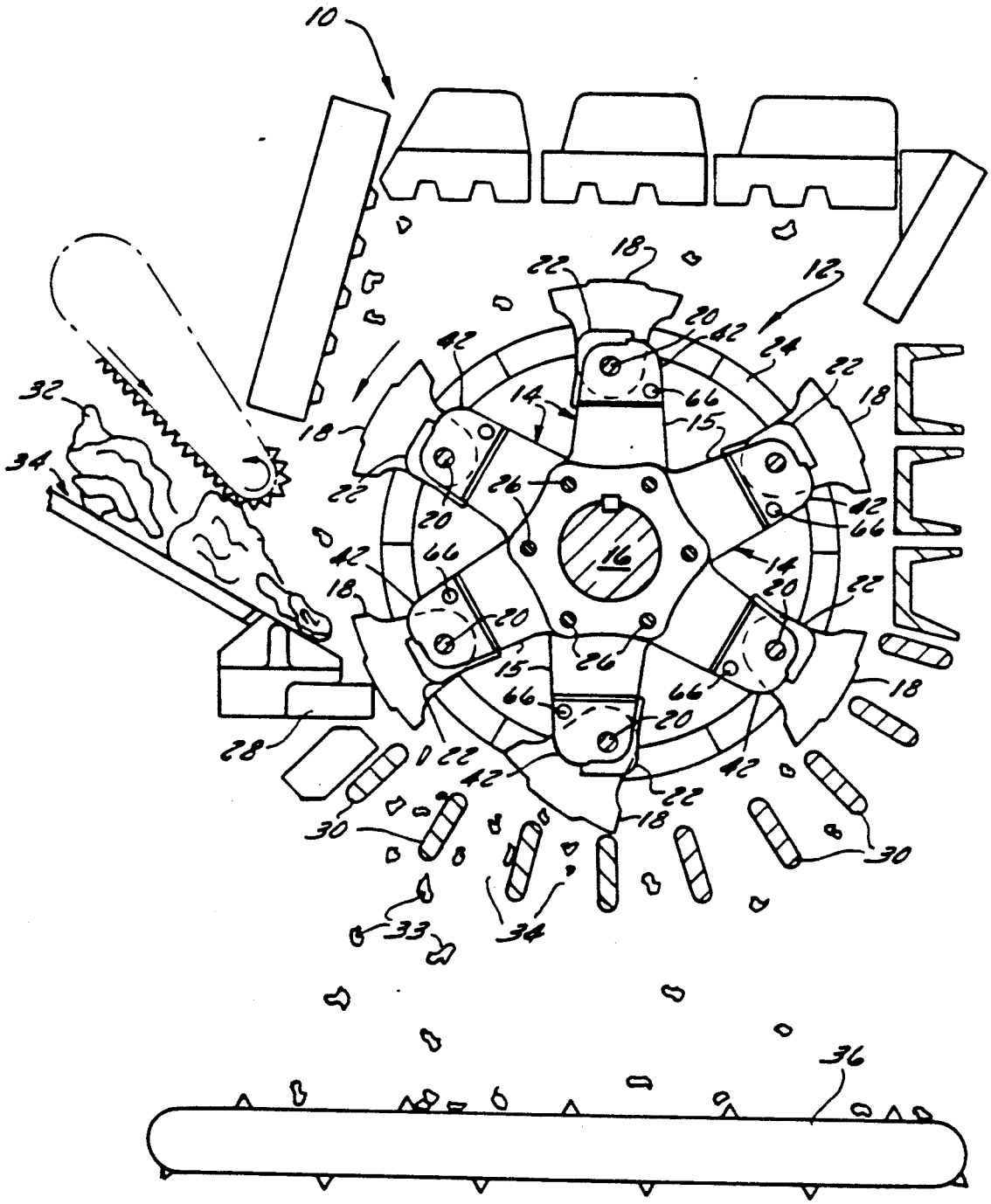
FIG. 1 is a sectional end view of a hammermill embodying the present invention.

Before describing one embodiment of the invention in detail, it is to be understood that the invention in not limited in its application to the details of construction and the arrangement of the components set forth in the following description or illustrated in the drawings. The invention is capable of other embodiments and of being practiced or carried out in various ways. Also, it is to be understood that the phraseology and terminology employed herein is for the purpose of description and should not be regarded as limiting.

DESCRIPTION OF THE PREFERRED EMBODIMENT OF THE INVENTION

Figure 2:
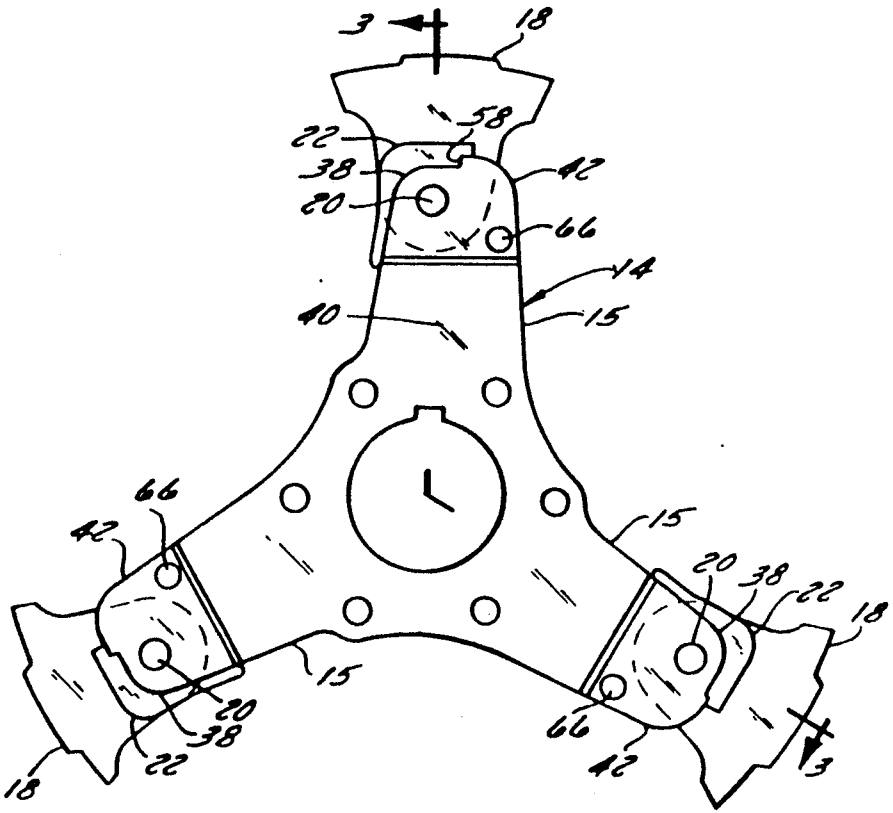
FIG. 2 is an end view of a spider assembly showing the hammer mounted on the replaceable end members on the ends of the spider arms.
Figure 3:
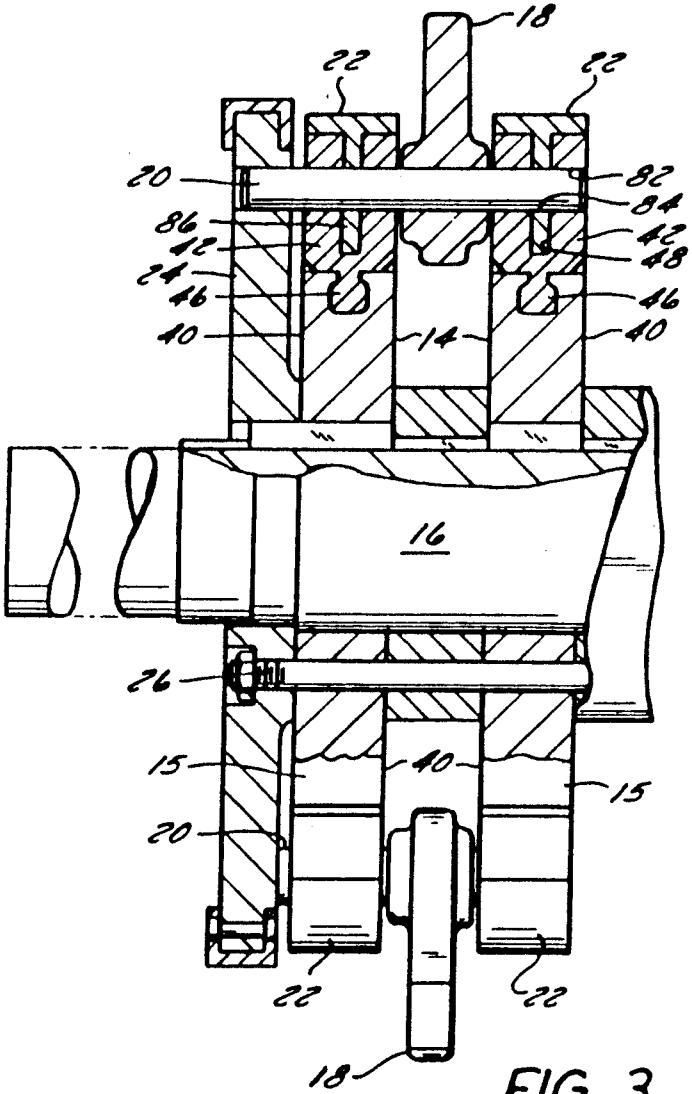
FIG. 3 is a partial view partially in section of a hammermill spider assembly.

Refering to FIGS. 1, 2, and 3 of the accompanying drawings, the numeral 10 designates generally a fragmentizing chamber of a shredder or hammermill which has a rotary hammer assembly 12 mounted therein. The hammer assembly 12 comprises a number of spider assemblies 14 which are mounted in axial alignment on and keyed to a drive shaft 16. Each spider assembly 14 includes a spider 17 having three arms 15, a replaceable end member 42 on the end of each arm and a protective cap or tip 22 on the end member 42. Although three arms 15 are shown on the spider 17, a spider having two or more arms could also be used. Each alternate spider assembly 14 is offset 60° to provide six rows of hammers 18 on the hammer assembly. The hammers 18 are mounted on shaft 20 which extend through openings 82 on the ends of the spider assemblies 14 so that the hammers 18 can swing freely between the spider arms 15. The ends of the spider arms 15 are equipped with protective caps 22 generally of the type described in U.S. Pat. No. 3,727,848 entitled "Hammer Mill with Replaceable Arm Tips" issued Apr. 17, 1973 to the same assignee.

A pair of end disks 24 are mounted on and keyed to the shaft 16 at each end of the assembly 12. The ends of shaft 16 extend through and past the end disks 24 and are received in bearings (not shown) that are structurally supported by the side walls of the shredder housing. The series of spider assemblies 14 and end disks 24 are secured together with tie rods 26 and are rotated as a unitary assembly by a motor (not shown).

In operation, the free swinging hammers 18 rotate with respect to the rotary hammer assembly 12 and coact with the teeth of a rigidly mounted cutting comb 28 that extends the length of the rotary hammer assembly 12 and with the grate bars 30 that are circumferentially spaced about the lower part of the orbit of the hammer circle to break up any material 32 entering the shredder through the inlet 34. When the pieces or fragments 33 into which the shredder breaks the incoming material reach a desired size, they fall through the spaces 34 between the grate bars 30 onto a delivery conveyor 36 which carries them from the shredder housing.

The hammers 18, comb 28 and grate bars 30 are formed of specially treated hardened steel. The spiders 17 and the end disks 24 because of their size and shapes are more effectively cast of softer steel. Although in operation the hammer 18, comb 28 and grate bars 30 are subject to most of the impact and wear associated with the shreding of scrap objects, the shredded pieces 33 do contact and cause erosion and wear of the leading edge and side walls of the spider arms 15. The areas most suseptible to wear on the spider arms 15 is the leading edge or impact area 38 as well as the side walls 40.

The protective caps or tips 22 which are of hard, wear-resistant steel protect the leading edges of the spider arms 15. The protective caps 22 are secured to the ends of the spider arms 15 and are retained in position by the hammer pins 20. The protective caps provide little, if any, protection to the side walls 40 of the spider arms 15. In the event of excessive wear of the side walls 40 of the spider arms 14 the hammermill must be shut down and the spider assembly disassembled to repair the spider arms or replace the spiders 14 in their entirety.

In accordance with the present invention, shut down time is reduced by providing replaceable end members 42 on the end of each of the spider arms 15. The end members are formed of the same material as the spiders and can be replaced without disassembling the hammer assembly from the hammermill. A high efficiency in the operation of the hammermill is thus maintained.

Figure 4:
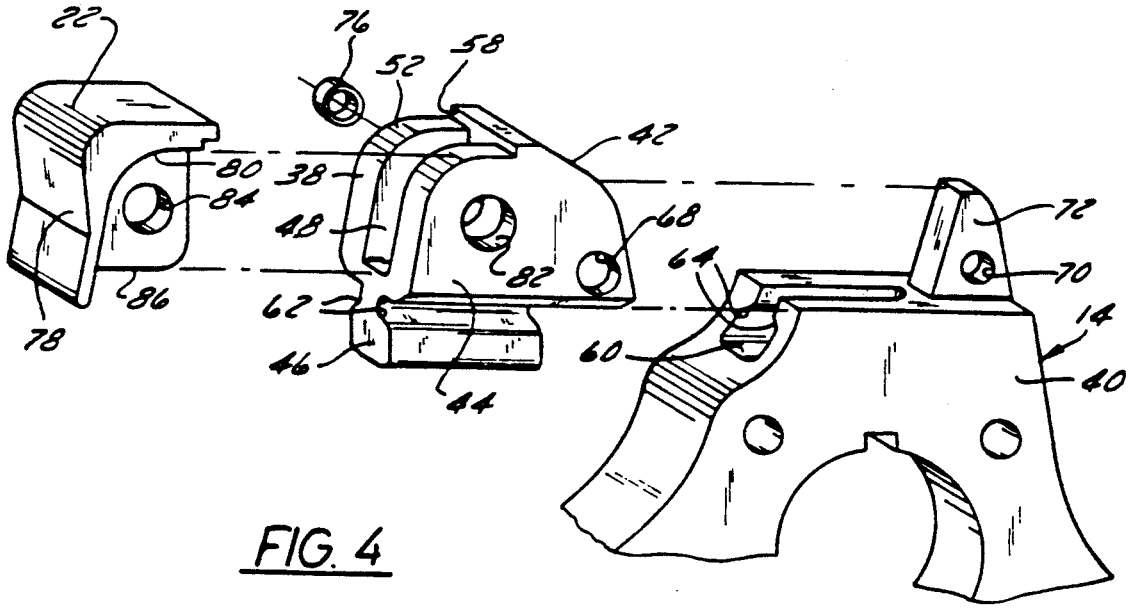
FIG. 4 is a perspective view exploded to show the relationship of the spider, end member and protective tip.

In FIG. 4 one embodiment of the replacement member 42 according to the present invention is shown. As seen in the drawing the end member 42 is mounted on and forms a continuation of the end of the spider arm 15. Each end member 42 is formed of a soft steel substantially as described in connection with the spiders 14. The end member 42 includes a body portion 44 having a slot 48 in the leading edge and a slot 50 in the trailing edge of the end member 42. The leading edge of the end member 42 has a contoured surface 52 which terminates at a step 58 on the end of the member 42.

Means is provided along the bottom of the member 42 for retaining the member 42 on the arm 15 against the centrifigal force due to the rotary motion of the hammer assembly. Such means is in the form of a web 46 which is configured to correspond to the shape of a socket 60 provided in the end of each spider arm 15. In this regard it should be noted that the web 46 is provided with an abuttment 62 on each side of the web 46. The socket 60 is also provided with abuttments 64 along each side of the socket 60 in a position to engage the abuttments 62 on the boss 46. The abuttments 62 should be in close contact with abuttments 64 so that the end member cannot move with respect to the spider.

The end member is retained in the socket 46 in the spider arm 15 by means of a radial extension 72 provided on the spider arm 15 and a pin 66 having a head 74. The pin 66 passes through holes 68 in the end member 42 and hole 70 in the extension 72. It should be noted that the holes 68 are larger than hole 70 in order to accommodate the pin head 74.

The end member 42 is mounted on the arm 15 by inserting the web 46 on the end member 42 into the slot 60 in the spider arm 15. The abuttments 62 will matingly engage the abuttments 64 in the walls of socket 60. The extension 72 is aligned in the slot 50 in the end member 42. The end member 42 is secured to the extension 72 by means of the pin 66 which is inserted into the holes 68 and 70.

The pin 66 is retained in the holes 68 and 70 by means of the head 74 on the pin 66 which is seated in the hole 68 one one side and a washer 76 which is mounted on the end of the pin 66 in the other hold 68. The washer 76 can be welded into the opening 68 or secured therein by any convenient means. The diameter of the pin 66 should be approximately the same size as the hole 70 to prevent wobble of the end member 42.

The contoured surface 52 of the end member 42 is protected by means of the protective cap or tip 22 which includes a contoured shroud 78 and a web 86 having a centrally located hole 84. The inside surface configuration 80 of the shroud 78 conforms to the curve of the contoured surface 52 on the end member 42. The shroud 78 is secured to the end member 42 by means of the web 86 that is inserted into the slot 48 in the end member 42. The hammer shaft 20 is inserted through openings 82 in the end member 42 and the opening 84 in the web 86 of the protective cap 22 to lock the tip 22 in place.

In order to replace the end members 42 in the event of excessive wear, the shaft 20 has to be removed from the hammer assembly. The pin 66 is then knocked out of the hole 70 and the end member 42 removed from the socket 60. If the tip 22 is also worn, it can be replaced at the same time.

Figure 8:
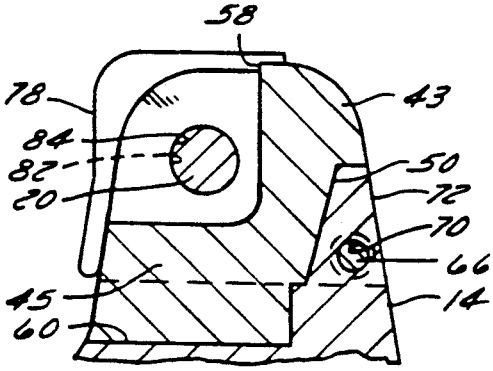
FIG. 8 is a view of a replacement end member for worn hammers.
Figure 5:
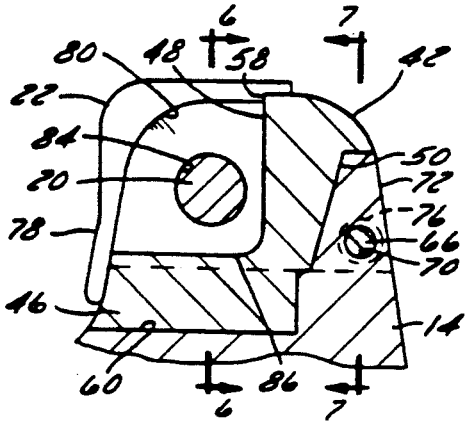
FIG. 5 is a section view of one end of a spider arm showing the end member and protective tip mounted on the spider arm.
Figure 6:
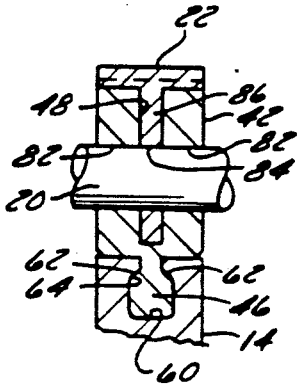
FIG. 6 is a view taken on line 6—6 of FIG. 5 showing the connection of the tip to the end member.
Figure 7:
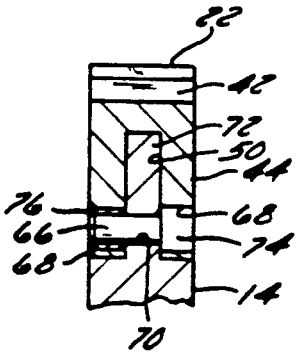
FIG. 7 is a view taken on line 7—7 of FIG. 5 showing the connection of the end member to the spider.

The present invention also contemplates the reuse of the hammers when they become worn. This is accomplished by merely removing the replaceable end member 42 with an end member 43 as shown in FIG. 8. It will be noted in the drawing that the end member is identical in all respects to the end member 42 except that body portion 45 has been enlarged so that the location of hole 82 is located at a greater distance from the axis of shaft 16. The hole 70 will remain in the same position and the shroud 78 does not have to be replaced unless it has become worn. With this arrangement, a worn hammer 19 mounted on the shaft 20 will again be in close proximity to the comb 28 and grate 30. The life of the hammer, therefore, is increased without any increase in cost to the hammer assembly.

The embodiments of the invention which an exclusive property or privilege is claimed are defined as follows:

1. A spider assembly for a rotary hammer assembly of a hammermill, said spider assembly comprising:

a spider having one or more radially extending arms;

a replaceable end member having a shape corresponding to the end of said arms mounted on the end of each of said arms; and a protective cap removably mounted on each of said end members.

2. The spider assembly according to claim 1 including means on each of said end members for securing said end members to each of said radially extending arms to hold said end members against the thrust of the centrifugal force produced by the rotary motion of the spider assembly.

3. The spider assembly according to claim 2 including means extending outwardly from said arms for holding said end member on said arm.

4. The spider assembly according to claim 3 including a pin for connecting said end member to said outwardly extending means.

5. The spider assembly according to claim 3 wherein said protective cap includes a shroud mounted on the leading edge of said end member for protecting the impact area of said end member.

6. The spider assembly according to claim 2 wherein said securing means comprise a web on the bottom of said end member, said web including an abuttment on each side for engaging a correspondingly shaped socket in said spider arm.

7. A spider assembly for a rotary hammer assembly of a hammermill, said spider assembly comprising:

a spider having one or more radially extending arms;

a replaceable end member mounted on the end of each of said radially extending arms;

means on each of said end members for securing said end members to each of said radially extending arms to hold said end members against the thrust of the centrifugal force produced by the rotary motion of the spider assembly, means extending outwardly from said arms for holding said end members on said arms, and a protective cap detachably mounted on each of said end members, each of said protective caps includes a shroud mounted on the leading edge of said end member for protecting the impact area of said end member, said end member includes a slot in said impact area of said member and said protective cap includes a web corresponding to said slot for locking said cap to said end member.

* * * * *